US007304614B2

(12) United States Patent
Silva

(10) Patent No.: US 7,304,614 B2
(45) Date of Patent: Dec. 4, 2007

(54) MOTOR-VEHICLE ROOF ANTENNA WITH SHEET-METAL BASE PLATE

(75) Inventor: David Silva, Nürtigen (DE)

(73) Assignee: Hirschman Car Communication GmbH, Neckartenzlingen (DE)

( * ) Notice: Subject to any disclaimer, the term of this patent is extended or adjusted under 35 U.S.C. 154(b) by 0 days.

(21) Appl. No.: 11/484,326

(22) Filed: Jul. 11, 2006

(65) Prior Publication Data

US 2007/0031198 A1 Feb. 8, 2007

(30) Foreign Application Priority Data

Jul. 13, 2005 (DE) ..... 10 2005 033 177

(51) Int. Cl.
*H01Q 1/32* (2006.01)

(52) U.S. Cl. ..... 343/713; 343/713; 343/711

(58) Field of Classification Search ..... 343/711, 343/713

See application file for complete search history.

(56) References Cited

U.S. PATENT DOCUMENTS

| | | | | |
|---|---|---|---|---|
| 5,689,276 | A * | 11/1997 | Uematsu et al. | 343/872 |
| 6,714,171 | B2 * | 3/2004 | Haussler et al. | 343/888 |
| 6,999,033 | B2 * | 2/2006 | Kordass et al. | 343/713 |
| 7,088,297 | B2 * | 8/2006 | Nakano et al. | 343/713 |
| 2004/0174311 | A1 | 9/2004 | Kordass et al. | |
| 2004/0247951 | A1 | 12/2004 | Inagaki et al. | |

FOREIGN PATENT DOCUMENTS

| | | |
|---|---|---|
| EP | 0 862 239 | 9/1997 |
| EP | 147 1603 | 10/2004 |

* cited by examiner

*Primary Examiner*—Douglas W. Owens
*Assistant Examiner*—Dieu Hien T Duong
(74) *Attorney, Agent, or Firm*—Andrew Wilford

(57) ABSTRACT

A motor-vehicle roof antenna has a base plate adapted to be fitted to the vehicle roof, a sending/receiving unit mounted on the base plate, and a mounting formation for securing the base plate to the roof. The base plate is stamped sheet metal.

10 Claims, 6 Drawing Sheets

MOTOR-VEHICLE ROOF ANTENNA WITH SHEET-METAL BASE PLATE

FIELD OF THE INVENTION

The present invention relates to motor-vehicle roof antenna. More particularly this invention concerns such an antenna with a sheet-metal base plate.

BACKGROUND OF THE INVENTION

Such roof antennas that are attached to or mounted on a flat surface of the vehicle, particularly a vehicle roof, are known. These roof antennas have a base plate designed as one cast element. Means for receiving and/or sending high-frequency signals, e.g. in the form of circuit boards with electrically conductive structures acting as an antenna or in the form of complete GPS modules, are attached to this base plate. A preferably aerodynamically designed plastic hood is set over these means arranged on the base plate and protects them from exterior influences.

The base plate itself has a threaded stem pointing downward that is cast integral with the base plate and that has a longitudinal slot. For sealing between the base plate and the vehicle roof an elastically moldable rubber-like seal ring can be provided.

A base plate made of one cast material has several disadvantages. On the one hand, large tolerance variations, particularly in the range of several tenths of a millimeter, cannot be avoided so that the installation of the receiving antennas and their sealing is inexact. In addition, such cast material is brittle so that there is some risk that the roof antenna might be damaged during installation when it is fastened to the vehicle roof by means of a threaded stem and a corresponding nut, if this fastening nut is tightened to much. The threaded stem might then break very easily, as the threaded stem generally has a longitudinal slot which makes it fairly fragile. Moreover, as a further disadvantage is to be considered that a certain minimum thickness of the cast base plate is necessary in order to ensure the stability required, which in connection with the material results in an unnecessarily excess weight.

OBJECTS OF THE INVENTION

It is therefore an object of the present invention to provide an improved motor-vehicle roof antenna with a base plate.

Another object is the provision of such an improved motor-vehicle roof antenna with a base plate that overcomes the above-given disadvantages, in particular that is inexpensive to manufacture and that can be easily produced and advantageously installed on the flat surface of the vehicle.

SUMMARY OF THE INVENTION

In a motor-vehicle roof antenna having a base plate adapted to be fitted to the vehicle roof, a sending/receiving unit mounted on the base plate, and a mounting formation for securing the base plate to the roof. The improvement wherein the base plate is stamped sheet metal.

According to the invention the base plate is a sheet metal part and can be produced in a punching and bending procedure. In order to produce the base plate, a sheet metal with a constant thickness is punched and bent and during this procedure those formations are punched and bent that are necessary for fastening of the roof antenna as well as for fastening of the coordinated means for the realization of the roof antenna's function. Among these are the means in the form of clips for fastening the means for receiving and/or sending the high-frequency signals that are punched out of the base plate and bent. These fastening means are of advantage as they can be easily produced and have also advantages concerning further machining. The clips can be caulked, soldered or machined in other ways when a circuit board with electrically conductive structures for the realization of an antenna is fastened on the base plate. By soldering for example a ground for shielding can be easily achieved, which cannot be done if the base plate is made of cast material that normally cannot be soldered to. Caulking or general shaping of the fastening means, in particular of the clips is easily possible when the base plate is made of sheet metal, since the sheet material has a different material structure than a cast base plate. With a cast base plate there is always the risk that one with cast-on clips breaks off when shaped.

The same is true as far as the means for fastening the base plate on the flat surface of the vehicle are concerned, wherein in the following it is assumed that this flat surface is a vehicle roof, although it does not have to be.

The base plate made of sheet metal according to the invention can be provided with an insert nut by means of which the base plate is fastened with a complementary fastening screw on the vehicle roof. Alternatively to the insert nut, a nozzle-shaped formation, formed out of the base plate, with an inner thread can be provided, into which the fastening screw can be screwed in as well. Thanks to the better material construction of sheet metal compared to cast material, material fracture caused by the application of too much force cannot occur, so that the installation of the roof antenna is significantly improved. The inserted nut for example leads to a substantial stabilization in the area of the base plate into which it is fitted.

In a further development of the invention the base plate has stiffening means. In a particularly advantageous embodiment of the invention such a stiffener is designed as a bar punched out of the base plate and bent. Otherwise the base plate with or without stiffening means can be formed such that an adaptation to the outer shape of the vehicle roof is ensured. For this purpose the base plate is for example slightly arcuate if the vehicle roof, too, is slightly curved in the region where the roof antenna is to be installed.

In a further embodiment of the invention the base plate has at least one, preferably more than one clamp clips pointed in the direction of the flat surface, in particular in the direction of the vehicle roof. They are also punched out of the base plate and bent off and can be inserted in at least one hole or opening of the vehicle roof. Thus the roof antenna is prepositioned and directionally fixed on the vehicle roof by means of the clamp clips that ensure a prepositioning and locking of the base plate once it is inserted into the opening of the vehicle roof and thereafter the final installation, for example by screwing the base plate to the vehicle roof, can be carried out. In a particularly advantageous embodiment of the invention, the clamp clips are designed differently for insertion in either differently designed openings or in an asymmetrical opening of the flat surface. Thus, a prefixation of the base plate of the roof antenna in its final position is ensured.

In one embodiment of the invention a seal ring can be fixed in different ways at least in the outer edge areas of the base plate. This seal guarantees that the openings in the flat component of the vehicle, at least the opening for fastening the base plate, are sealed against the surroundings and that no water can permeate into the inner area of the vehicle.

According to the invention the seal can be form-fittingly connected to the base plate as a separate component and has means fastening it to the base plate. The seal can be is glued on or sprayed or formed directly on the base plate.

Thus, the roof antenna, which can be prefabricated in form of a module, consists of a base plate made out of sheet metal, the base plate being provided with a seal and the means for sending and/or receiving high-frequency signals (radio or television signals, GPS signals and the like). For the protection of these means a plastic cover hood is provided that protects the inner area of the roof antenna against exterior influences.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
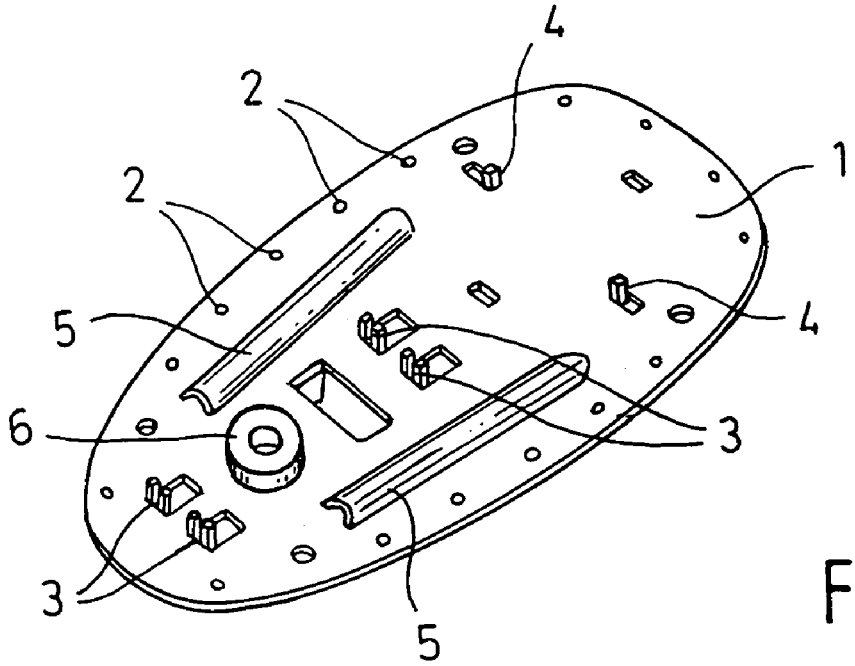
FIG. 1 is a perspective view of a base plate made of sheet in a punching and bending procedure.

As seen in FIG. 1 a base plate 1 is made of a sheet metal and produced in a punching and bending procedure. For this purpose, a sheet is stamped such that it matches the outer shape of the base plate 1 that here is ellipsoidal, but obviously other geometrical forms can be chosen as well. In the outer-edge area of the base plate 1 there are seats 2 (for example bore holes) so the unillustrated cover hoot can be screwed to the base plate 1. Furthermore, projections 3 with a fastening function are punched out and bent up, as well as fastening clips 4. For stiffening the base plate 1, U-section channels or bars 5 are punched out and bent up, here extending longitudinally of the base plate 1. These bars 5, if present, can also or alternatively be arranged transverse to the base plate 1 or not be provided at all. Finally, in this embodiment the base plate 1 is also provided with an insert nut 6, by means of which the base plate 1 can be fastened on the flat surface of the vehicle by means of a fastening screw.

Figure 2:
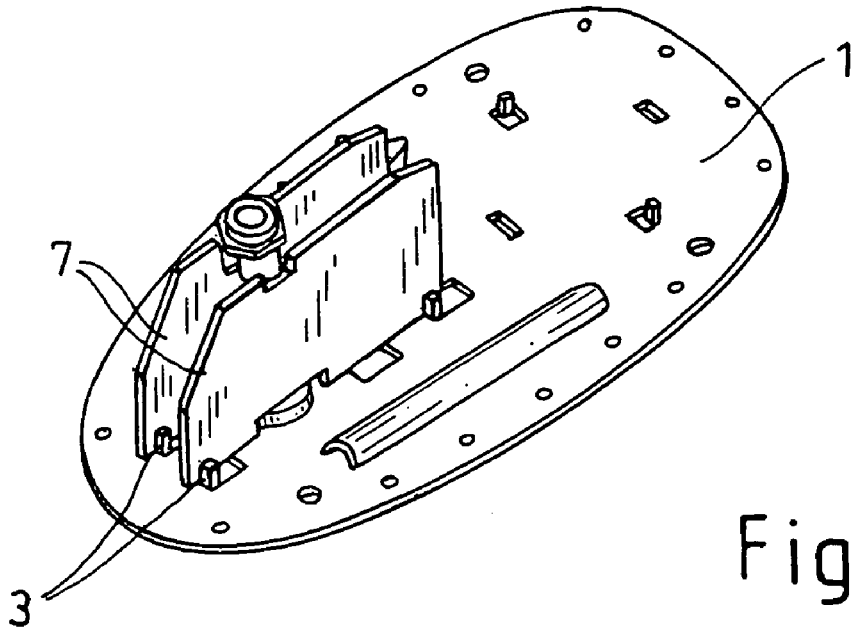
FIG. 2 shows the same base plate on which circuit boards are arranged in perpendicular position and parallel to each other.

FIG. 2 shows the base plate 1 on which two circuit boards 7 are mounted, extending perpendicular to the board 1 and parallel to each other, fixed by means of the projections 3. The projections 3 can easily and without risk of breaking be deformed after their production such that the circuit boards 7 are fixed to the base plate 1. Alternatively or complementarily at least one projection 3 can also be soldered to an electrically conductive surface or trace on the circuit board 7, particularly for grounding or shielding.

Figure 3:
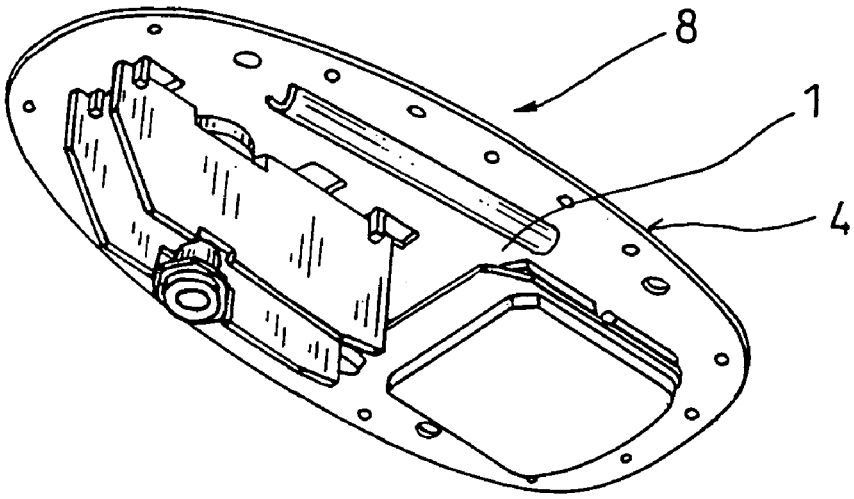
FIG. 3 shows a base plate with an installed GPS-module.
Figure 4:
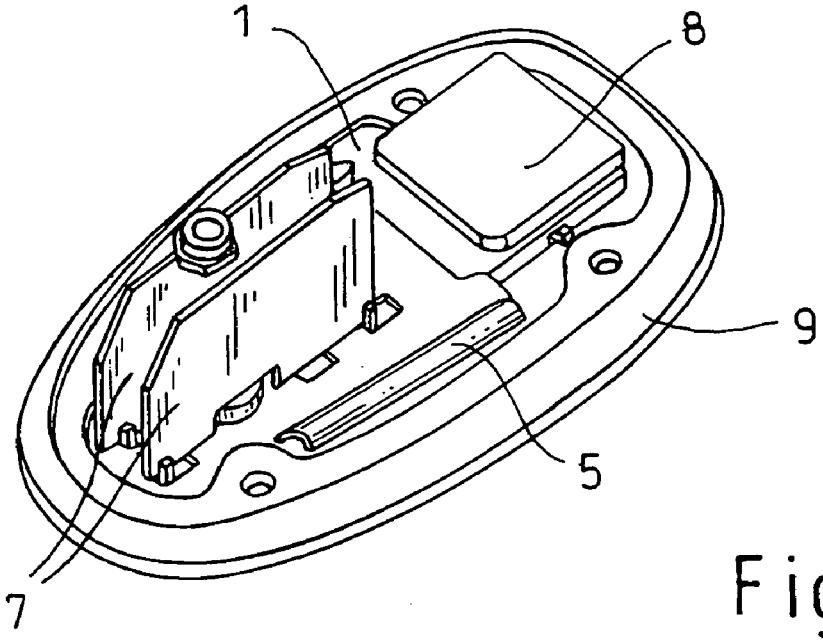
FIG. 4 shows the base plate with the circuit boards and the GPS-module and at least one seal surrounding the marginal area.

FIGS. 3 and 4 show the base plate 1 with an installed GPS-module 8 which is a prefabricated part flatly fastened to the base plate 1 by means of the fastening clips 4. In order to avoid irradiations or reflections of perturbing radiations into or out of the GPS-module, it may be provided that either surrounding blanks are punched out of the base plate 1, into which the GPS-module 8 is inserted, for which alternatively to it an additional housing surrounding the GPS-module 8 laterally and in the direction of the base plate 1 is fastened, receiving the GPS-module 8. Either way, attention should be paid that the GPS-module remains free on its upper side in order to receive satellite signals. To this end the unillustrated cover hood is made of plastic. The GPS-module 8 is fastened on the base plate 1 by deformation of the fastening clips 4. If the GPS-module is contained in a housing inside the plastic hood, this housing can of course be also fastened with the fastening clips 4 and, if necessary, be soldered in place.

FIG. 4 shows the base plate 1 with the circuit boards 7 and the GPS-module 8 thereon, as well as a seal ring 9 surrounding at least the outer-edge area of the base plate 1. It is clear that the seal 9 on the upper side of the base plate 1 reaches so far into the inner area that the fastening bore holes for the cover hood and the receiving area for the lower front side of the cover hood are also formed by the seal 9.

Figure 5:
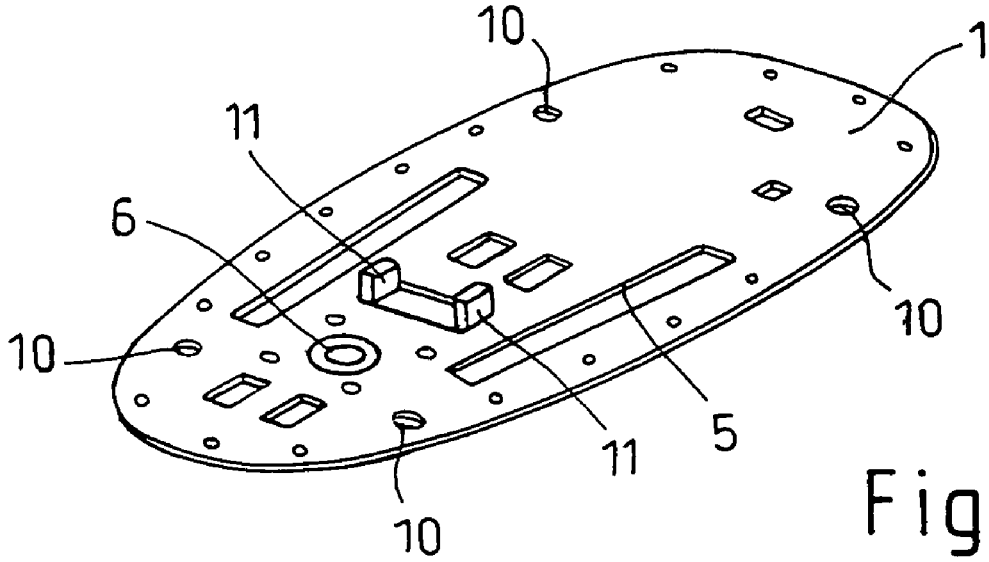
FIG. 5 shows the bottom of the base plate, that is the side with which the base plate rests on the flat surface of the vehicle.

FIG. 5 shows the bottom side of the base plate 1, that is the side with which the base plate rests on the flat surface of the vehicle. This area of the base plate 1 can be partially or completely covered by the seal 9. In FIG. 5 reference 10 indicates fastening bore holes through which fastening screws are is inserted from the bottom side in the direction of the cover hood so that the cover hood can thus be screwed together with the base plate 1. Furthermore, the base plate 1 has clamp clips 11 pointing downward. The base plate 1 can be inserted in an opening of the flat component of the vehicle and be pre-fixed there by these clips 11. The actual fastening of the base plate 1 of the roof antenna in this exemplary embodiment is carried out by the insertion of a fastening screw in the insert nut 6. Subsequent to the tightening of a fastening screw 12 (FIG. 6), the roof antenna with its base plate 1 is in its permanent position on the flat component of the vehicle as desired. Furthermore, the punching of the clamp clips 11 out of the base plate is of advantage, since the base plate 1 has a hole through which the necessary unillustrated connector cables pass. The received signals of the roof antenna can be transmitted to the corresponding downstream analyzing unit through these cables.

Figure 6:
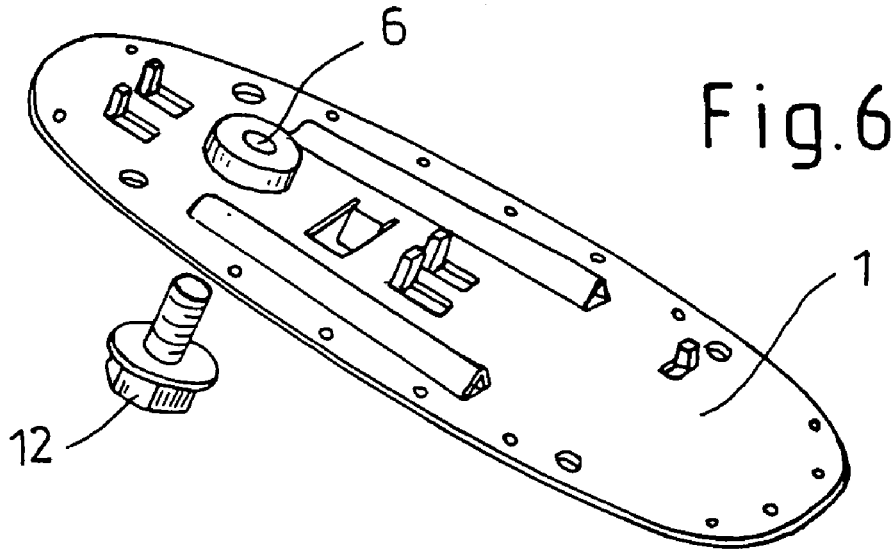
FIG. 6 shows the base plate with an insert nut and a complementary fastening screw.

FIG. 6 shows the base plate 1 with the insert nut 6 and the coordinated fastening screw 12. Installation of the roof antenna with the base plate 1 according to the invention is advantageous due to the fact that the roof antenna can be pre-fixed or snapped into its position via the clamp clips 11 and the final positioning and fastening of the roof antenna can be carried out with the fastening screw 12 by screwing it into the insert nut 6. Regarding the fastening screw 12, at least two further advantages have to be mentioned: on the one hand, a standard and thus inexpensive locking-type fastening screw with a saw tooth arranged at the underside of the screw head can be used that leads to an certain electric contact due to the saw tooth design of the underside of the fastening screw's 12 head when the fastening screw 12 is tightened against the flat surface of the vehicle, generally consisting of metal. Such contact is still necessary, as it already was for hitherto existing roof antennas for grounding or respectively shielding, but this result is achieved thanks to much simpler means here.

Figure 7A:
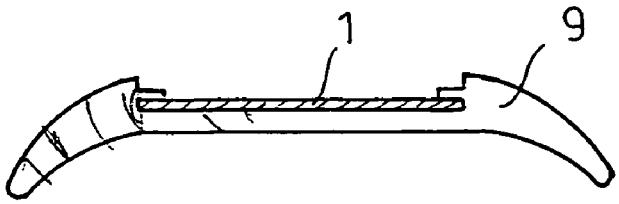
FIGS. 7*a*-7*e* show in end view several arrangements of a seal on the base plate.
Figure 7B:
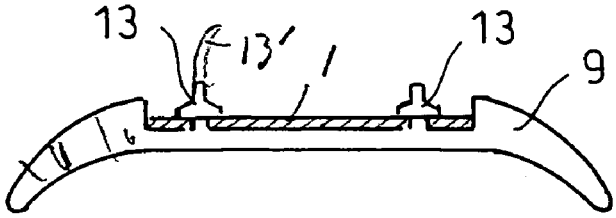
Figure 7C:
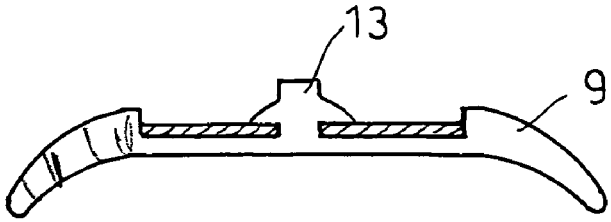
Figure 7D:
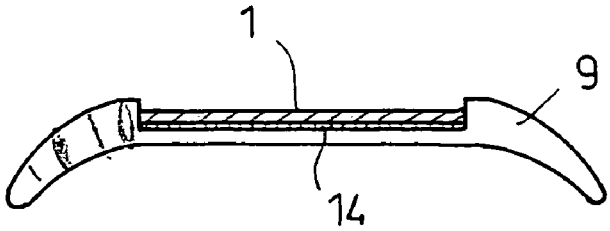
Figure 7E:
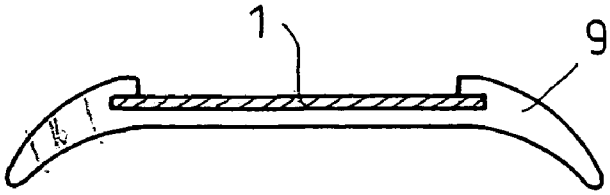

FIGS. 7*a*-7*e* show several illustrations of possible arrangements of the seal 9 on the base plate 1. FIG. 7*a* shows that the seal 9 is form-fittingly connected to the base plate 1 and has surrounding seal lips above the base plate 1. FIG. 7*b* shows that the seal 9 has at least one, preferably more than one fastening nipples 13 with a mushroom-shaped profile with an extension tab 13' projecting through the plate 1 . The mushroom profile of the fastening nipple 13 can be manually drawn by means of the extension tab 13' through an opening in the base plate 1 and to lock the formation in place. Subsequently, the tab 13' can be cut off as shown on the right n FIG. 7*b*, but does not have to be. The same is true for the embodiment according to FIG. 7*c*, wherein the fastening nipple 13 there has a bigger profile and thus one single fastening nipple 13 is sufficient, while if smaller fastening nipples 13 as illustrated in FIG. 7*b* are used, several of them are necessary. FIG. 7*d* shows that the base plate 1 is connected to the seal 9 by a layer 14 of glue or adhesive. The seal 9 and/or the base plate 1 can for example be connected by a layer 14 of adhesive on both sides, in addition to which an adhesive layer 14 can be used which is applied to the base plate 1 and the seal 9 after their fabrication and which is subsequently activated. FIG. 7*e* finally shows that the seal 9 is sprayed or molded on around the base plate 1. A particular advantage to be mentioned here is that the sheet metal base plate 1 has extremely low tolerances, particularly in the range of hundredths of millimeters, so that the injection molding procedure for realization of the seal 9 can be significantly improved. Thanks to the tight tolerances, an injection molding die which is fitted to the base plate 1 can seal the sheet metal base plate 1 significantly better than it could a cast part, so that while the seal material is sprayed on much less material or no material at all will leak. This cannot be achieved in the case of base plates designed as one single cast part, as these plates have significantly looser tolerances.

Figure 8A:
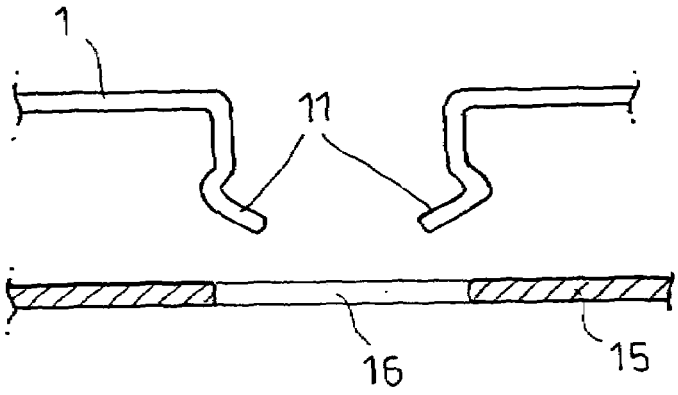
FIGS. 8*a*-8*c* show different variants of clamp clips.
Figure 8B:
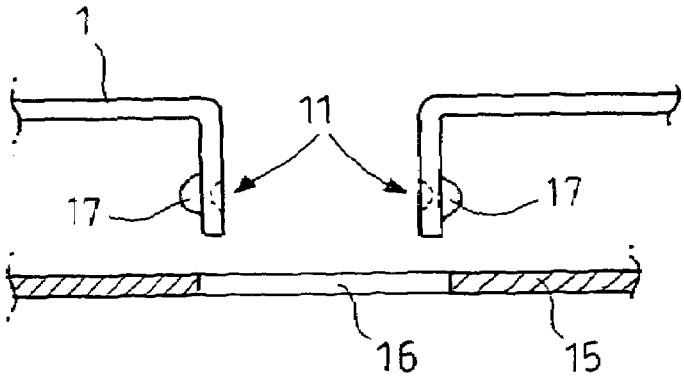
Figure 8C:
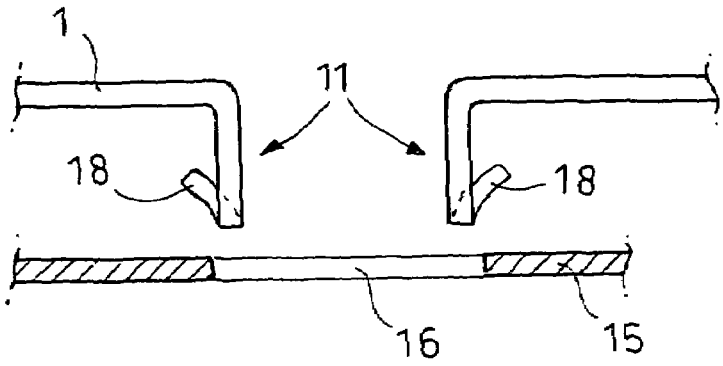

FIGS. 8*a*-8*c* shows different variants of the clamp clips 11. In FIG. 8*a* the clamp clips 11 are punched out of the base plate 1 and bent semi-circularly at their ends in order to be able to premount the base plate 1 on the flat component of the vehicle, here on a vehicle roof 15. The clamp clips 11 are forced with elastic deformation through a hole or opening 16 of the vehicle roof 15 so that the arcuate ends of the clamp clips 11 reach behind the bottom side of the vehicle roof 15 and secure the base plate 1 on the vehicle roof 15. The clamp clips 11 according to FIG. 7*b* have the same function, but are provided is with projections 17 which can be stamped out of the end section of the clamp clips 11. These projections or bumps 17 as well as barbs 18 according to FIG. 8*c* reach behind the vehicle roof 15 in the area of the opening 16 in order to premount the base plate 1 on the vehicle roof 15.

Figure 9A:
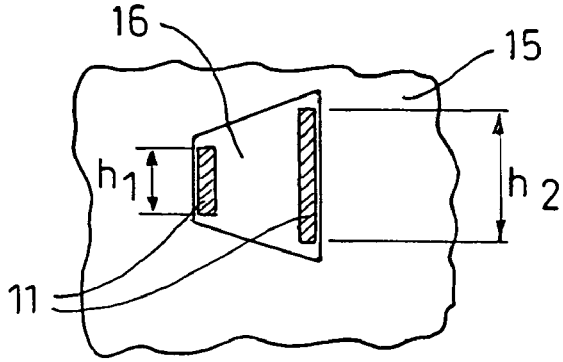
FIGS. 9*a*-9*c* show clamp clips in different designs.
Figure 9B:
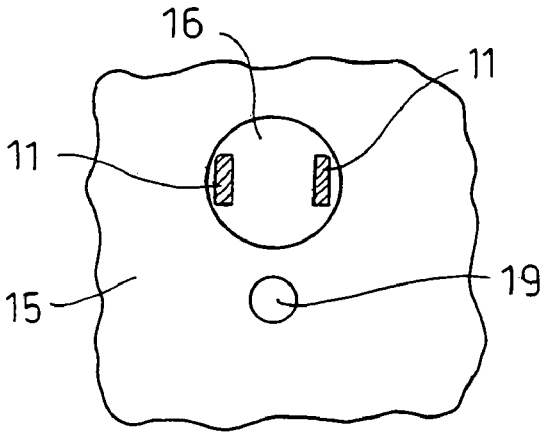
Figure 9C:
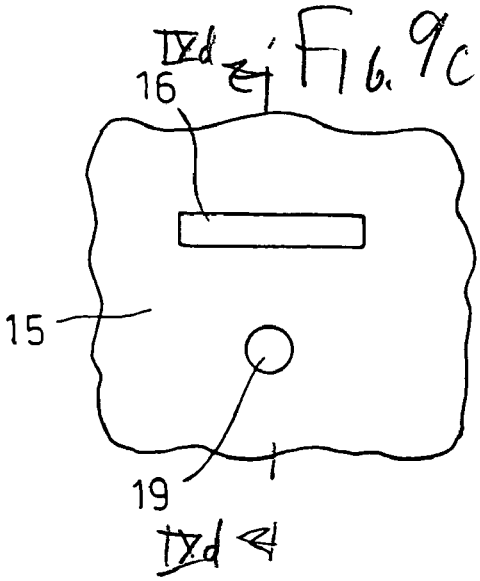
Figure 9D:
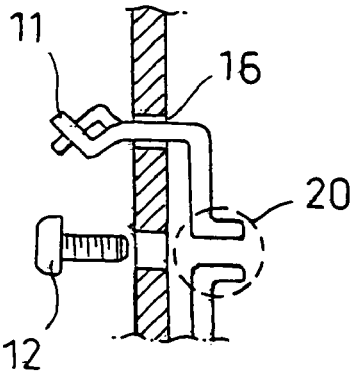
FIG. 9*d* is a section taken along line Ixd-IXd of FIG. 9*c*.

Finally, FIGS. 9*a*-9*d* shows the clamp clips 11 in a different design in order to be able to insert the plate 1 in a single opening 16 or in two openings 16 and 19 in the vehicle roof 15. FIG. 9*a* shows a single opening 16 in the vehicle roof 15 and two clamp clips 11 of different longitudinal extension corresponding to the asymmetric isosceles-trapezoidal shape of the opening 16. The one clamp clip is shorter (height $h_1$) than the other clamp clip 11 with a height $h_2$. Due to this design both the opening 16 and the clamp clip 11, the base plate 1 and thus the whole roof antenna can be preinstalled on the vehicle roof 15 in only one position, namely the right one. The same is true for the embodiment according to FIG. 9*b*, where the two clamp clips 11 are designed in the same way and inserted into a circular opening 16. The vehicle roof 15 has a second opening 19 for correct prepositioning, in that it receives a positioning pin punched out of the base plate 1 and bent off, or a clamp clip. FIG. 9*c* has two different openings 16 and 19 in the vehicle roof 15 with the clamp clips 11 inserted into these openings 16 and 19 adapted to the geometrical form of these openings 16 and 19. In FIG. 9*d* a nozzle-shaped seat 20 can be seen, also produced by punching and bending the material of the base plate 1 as two tabs with confronting threaded faces. For it is also possible to use a self-tapping screw, so that no thread has to be arranged on the base plate. Then the fastening screw 12 is screwed in to fasten the base plate and thus the whole roof antenna on the vehicle roof 15.

Concluding, the installation procedure of the roof antenna is once more briefly described:

After the production of the base plate 1 in a punching and bending procedure it assembled to a complete, operational module with the means for sending and/or receiving the high-frequency signals as well as the coordinated cables, the seal and the cover hoot installed. This completed roof antenna is prepositioned by means of the clamp clips 11 on the vehicle roof 15 and snapped into place, this prepositioning advantageously only allowing mounting in the right position due to the designs as shown and described in FIGS. 9*a*-9*d*. Subsequently the final installation is carried out from below by inserting the fastening screw 12 into the insert nut 6 or into the nozzle-shaped seat 20. Instead of the insert nut 6 a self-tapping screw can be used, the end of which reaches through the corresponding opening in the vehicle roof so that it can be screwed together into a seat formed on the base plate. Instead of screws and nuts with threads other fastening modes might be possible, such as e.g. a pin pressed in the base plate with a surrounding recess, into which after the installation of the roof antenna a safety ring or e.g. a bayonet-like fastening is snapped in place.

It is a further advantage of the base plate made of sheet metal that due to the low material thickness the base plate has to be warmed only slightly when the base plate the molten material forming the seal 9 is sprayed around the base plate.

I claim:

1. In a motor-vehicle roof antenna having a base plate adapted to be fitted to the vehicle roof, a sending/receiving unit mounted on the base plate, and means including a mounting formation for securing the base plate to the roof, the improvement wherein the base plate is stamped sheet metal formed unitarily with a U-section rib punched out and bent up forming a stiffening formation.

2. The improved motor-vehicle roof antenna defined in claim 1 wherein the base plate is unitarily formed with holding formations for the sending/receiving unit.

3. The improved motor-vehicle roof antenna defined in claim 1 wherein the mounting formation is a threaded seat.

4. The improved motor-vehicle roof antenna defined in claim 3 wherein the mounting formation is a nut fitted to the plate.

5. The improved motor-vehicle roof antenna defined in claim 3 wherein the mounting formation is a pair of spaced bent-up lips of the plate having confronting threaded faces.

6. The improved motor-vehicle roof antenna defined in claim 1 wherein the mounting formation is a pair of spaced tabs adapted to fit elastically in a hole in the roof.

7. The improved motor-vehicle roof antenna defined in claim 1, further comprising an annular flexible seal engaged between an outer edge of the plate and the roof.

8. The improved motor-vehicle roof antenna defined in claim 7, further comprising means for securing the seal to the outer edge of the plate.

9. The improved motor-vehicle roof antenna defined in claim 8 wherein the means for securing is an adhesive.

10. The improved motor-vehicle roof antenna defined in claim 8 wherein the seal is molded on the plate.

* * * * *